US011047120B2

(12) United States Patent
Kiddell et al.

(10) Patent No.: US 11,047,120 B2
(45) Date of Patent: Jun. 29, 2021

(54) SHOWER MAT WITH AUXILIARY SHOWER SPRAY HOSE

(71) Applicants: William Lee Kiddell, Sunrise, FL (US); Patrick John Zone, Sunrise, FL (US)

(72) Inventors: William Lee Kiddell, Sunrise, FL (US); Patrick John Zone, Sunrise, FL (US)

( * ) Notice: Subject to any disclaimer, the term of this patent is extended or adjusted under 35 U.S.C. 154(b) by 73 days.

(21) Appl. No.: 16/653,257

(22) Filed: Oct. 15, 2019

(65) Prior Publication Data

US 2021/0108399 A1 Apr. 15, 2021

(51) Int. Cl.

| | |
|---|---|
| ***A47K 3/28*** | (2006.01) |
| ***E03C 1/06*** | (2006.01) |
| ***E03C 1/04*** | (2006.01) |
| ***B05B 1/18*** | (2006.01) |
| ***A47K 3/00*** | (2006.01) |

(52) U.S. Cl.

CPC ..... *E03C 1/06* (2013.01); *A47K 3/002* (2013.01); *A47K 3/281* (2013.01); *B05B 1/185* (2013.01); *E03C 1/0408* (2013.01); *E03C 2201/30* (2013.01)

(58) Field of Classification Search

CPC ..... E03C 1/06; E03C 1/0408; A47K 3/002; A47K 3/281; B05B 1/185

USPC ..... 4/606, 601

See application file for complete search history.

(56) References Cited

U.S. PATENT DOCUMENTS

| | | | | |
|---|---|---|---|---|
| 3,292,185 | A * | 12/1966 | Lucian | E03C 1/0408 4/615 |
| 4,151,618 | A * | 5/1979 | Carpenter | A47C 7/74 5/284 |
| 4,934,000 | A * | 6/1990 | Freedman | A47K 3/001 239/569 |
| 5,774,907 | A * | 7/1998 | Doggwiler | A47K 7/046 15/104.92 |
| 6,183,430 | B1 * | 2/2001 | Lin | A47K 3/00 4/541.1 |
| 10,278,544 | B1 | 5/2019 | Kiddell et al. | |

* cited by examiner

*Primary Examiner* — Huyen D Le

(74) *Attorney, Agent, or Firm* — Dunlap Bennett & Ludwig, PLLC; Brendan E. Squire

(57) ABSTRACT

A shower mat is configured to carry an auxiliary shower spray conduit to deliver a spray vertically upwards to allow the user to clean their lower body and extremities. The mat may include a plurality of layers with the auxiliary shower spray conduit carried between the plurality of layers. Tubing interconnects the auxiliary spray hose to a diverter valve that is, in turn, connected to a stem of a shower enclosure. The auxiliary shower spray conduit is oriented in a serpentine shape and has a plurality of a spray hose that are aligned with a corresponding plurality of jet apertures defined through a surface of an upper mat.

15 Claims, 4 Drawing Sheets

SHOWER MAT WITH AUXILIARY SHOWER SPRAY HOSE

BACKGROUND OF THE INVENTION

The present invention relates to showers for bathing, and more particularly to shower mats and auxiliary shower spray hose.

For many individuals, particularly the elderly, disabled, or others with limited flexibility, it can be difficult to appropriately clean their feet, legs, and lower body. While the stream of water from a conventional wall mounted shower head may be utilized for bathing the lower extremities for more agile individuals, the inability of an individual to safely reach their legs and feet presents problems for others.

Auxiliary mounted shower heads are known and can assist users with directing the shower spray. However, the user must hold the shower head to direct the spray to their lower extremities. This may make it difficult for the user to apply a cleaning agent, such as soap, while they hold the auxiliary shower head. For those that need to stabilize themselves while showering, this can present an unnecessary safety risk.

As can be seen, there is a need for an apparatus and method for bathing assistance for the lower body and extremities.

SUMMARY OF THE INVENTION

In one aspect of the present invention, a shower mat with auxiliary shower spray conduit is disclosed. The shower mat includes a first mat formed of a resilient material having a plurality of bristles disposed in a spaced apart relation about a top surface of the mat. An auxiliary shower spray conduit is disposed in a serpentine orientation subjacent to the first mat. The auxiliary shower spray conduit is configured to connect to a pressurized water source. A plurality of spray nozzles are disposed in a spaced apart relation along a length of the auxiliary shower spray conduit. A plurality of jet apertures are disposed through the first mat and aligned with the plurality of spray nozzles and oriented to direct a flow from the pressurized water source carried through the auxiliary shower spray conduit vertically upwardly.

In some embodiments, the shower mat includes a plurality of spacers extending from a bottom surface of the first mat. The plurality spacers define a cavity subjacent to the first mat to contain the auxiliary spray conduit. A suction cup may be positioned a bottom end of the plurality of spacers.

In other embodiments, a second mat is provided having a smooth top surface and a plurality of suction cups disposed about a bottom surface of the second mat. A plurality of clips may secure the auxiliary shower spray conduit to one or more of the first mat or the second mat.

In yet other embodiments, a diverter valve is connectable between a stem of a shower enclosure and a primary shower head of the shower enclosure. The diverter valve is operable between a first position directing a flow of pressurized water to the primary shower head and a second position directing the flow of pressurized water to the auxiliary shower spray conduit. The diverter valve may direct a proportion of the flow between the primary shower head and the auxiliary shower spray conduit when operated at an intermediate position between the first position and the second position. An elongate tube may be provided having a first end and a second end. The first end is adapted to connect to the diverter valve and the second end is adapted to connect to an inlet of the auxiliary shower spray conduit. A tubing connector segment may also be interposed between the inlet and the second end of the tubing.

In other aspects of the invention, a shower mat with auxiliary shower spray conduit is disclosed that includes a first mat formed of a resilient material having a plurality of jet apertures disposed in a spaced apart relation through the first mat. An auxiliary shower spray conduit is disposed in a serpentine orientation subjacent to the first mat. The auxiliary shower spray conduit is configured to connect to a pressurized water source. A plurality of spray nozzles are disposed in a spaced apart relation along a length of the auxiliary shower spray conduit. The plurality of spray nozzles are aligned with a corresponding one of the plurality of jet apertures.

In some embodiments, a plurality of bristles are disposed in a spaced apart relation about a top surface of the first mat.

In other embodiments, a plurality of spacers extend from a bottom surface of the first mat, the plurality spacers defining a cavity subjacent to the first mat to contain the auxiliary spray conduit. A suction cup may be connected at a bottom end of the plurality of spacers.

In yet other embodiments, a second mat has a smooth top surface and a plurality of suction cups disposed about a bottom surface of the second mat. The shower mat may also have a plurality of clips to secure the auxiliary shower spray conduit to one or more of the first mat or the second mat.

These and other features, aspects and advantages of the present invention will become better understood with reference to the following drawings, description and claims.

DETAILED DESCRIPTION OF THE INVENTION

Figure 1:
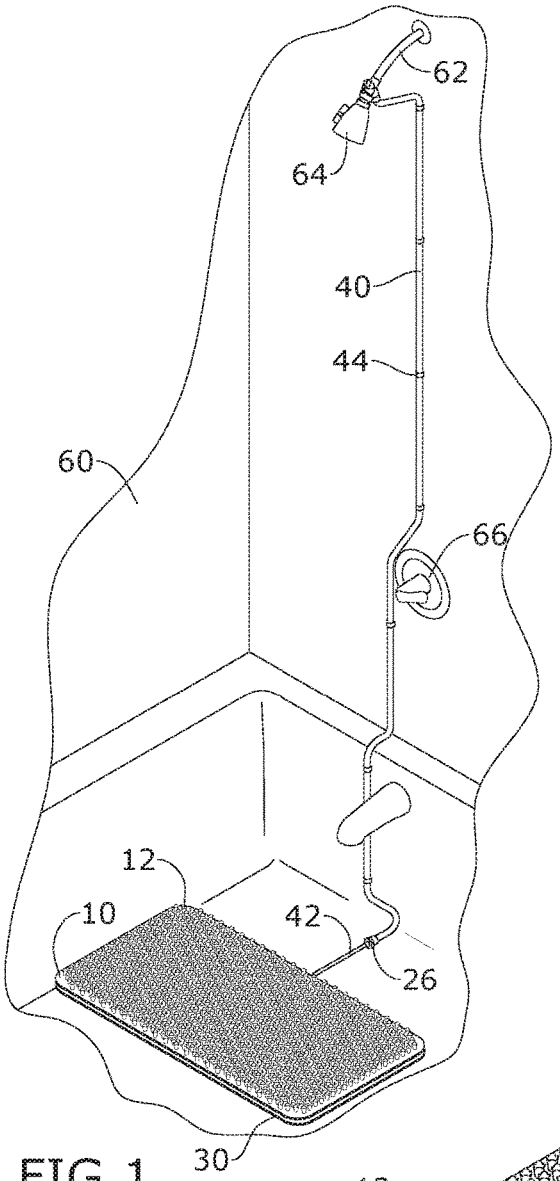
FIG. 1 is a perspective view of the shower mat with auxiliary shower spray hose, shown in use.
Figure 2:
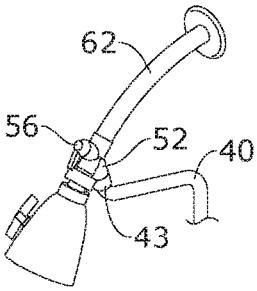
FIG. 2 is a perspective view of the shower mat with auxiliary shower spray hose, shown in an exemplary assembly.
Figure 2:
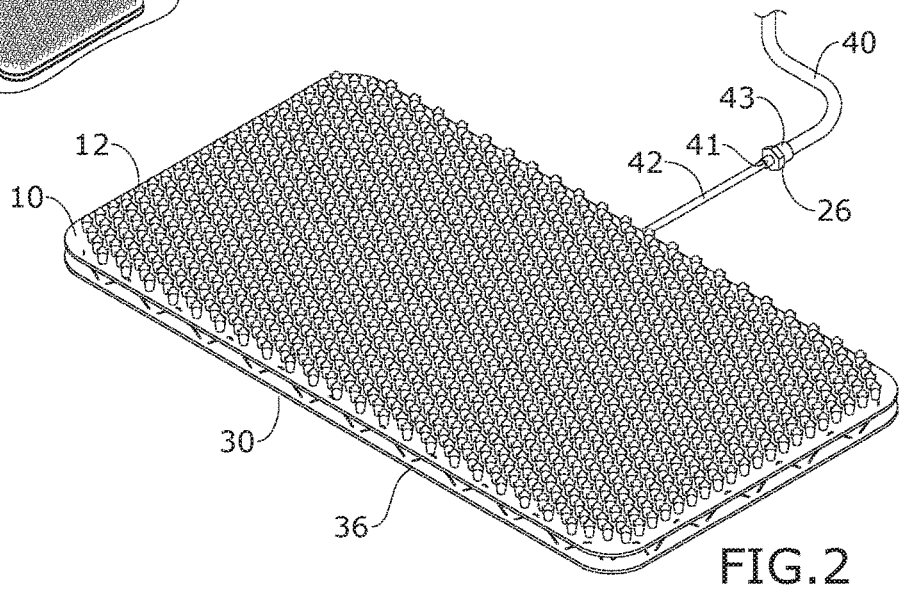

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, embodiments of the present invention provide a shower mat with an auxiliary shower hose, in which the shower mat, provides a sure footing for the user and carries the auxiliary shower hose so that user may clean their lower body and extremities.

As seen in reference to the drawings of FIGS. 1-4, the shower mat with an auxiliary shower hose of the present invention includes a shower mat that has an auxiliary shower spray conduit 20 carried therein. The spray conduit 20 has a plurality of spray holes 21 that are oriented to direct a vertical shower stream of water against the user's lower body and extremities to assist with cleaning and hygiene. The auxiliary shower spray conduit 20 is disposed in a serpentine pattern between the upper shower mat 10 and the lower shower mat 30.

Tubing 40 interconnects a fitting 24, such as a T-fitting on the auxiliary shower spray conduit 20 to a stem 62 of a shower enclosure via tubing connector 43 to a diverter valve 50. The stem 62 selectively communicates a source of pressurized water to the diverter valve 50 via conventional water control valves 66 within a shower enclosure 60. The diverter valve 50 includes a tubing connection 52, a primary head connection 54, and a diverter valve handle 56 that is operable to selectively regulate the flow of water through the diverter valve 50 to one or more of the primary shower head 64 and the auxiliary shower spray conduit 20.

In a first position, the diverter valve 50 may direct a full water flow to the primary shower head 64. In a second position, the diverter valve may direct a full water flow to the auxiliary shower spray conduit 20. In an intermediate position between the first position and the second position, the water flow may be directed to each of the primary shower head 64 and the auxiliary shower spray conduit 20.

The tubing 40 may include tubing connector segment 42 to communicate the water through the upper shower mat 10 to the auxiliary shower spray conduit 20. One or more clips 44 may be employed secure the tubing 40 within the shower enclosure.

Figure 3:
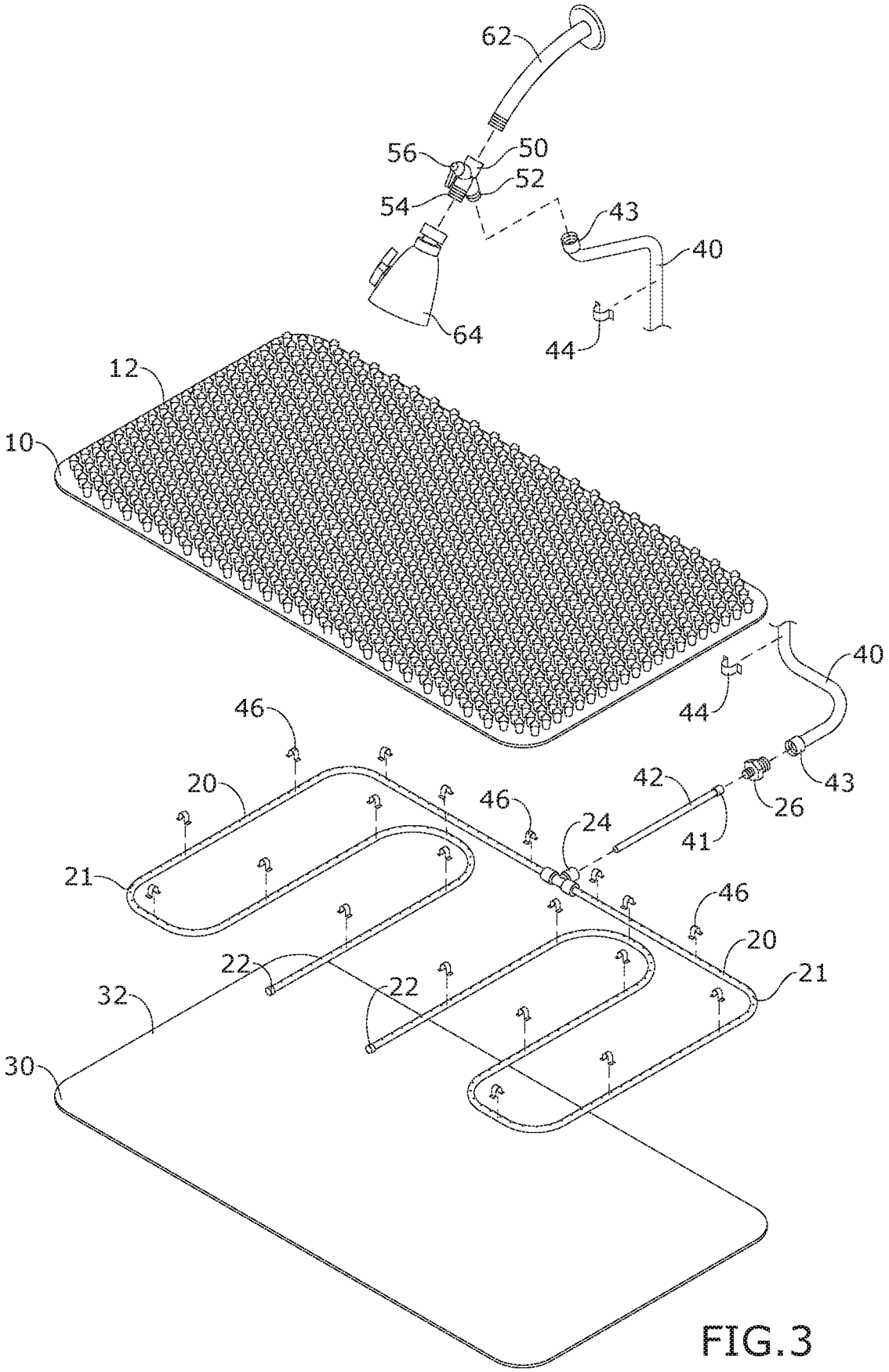
FIG. 3 is an exploded view of the shower mat with auxiliary shower spray hose.
Figure 4:
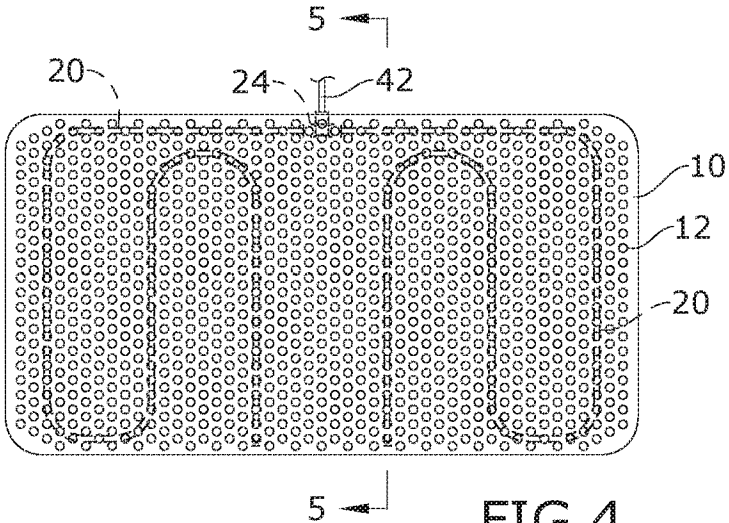
FIG. 4 is a top plan view of the shower mat with auxiliary shower spray hose, showing a path of the auxiliary shower spray conduit 20.
Figure 5:
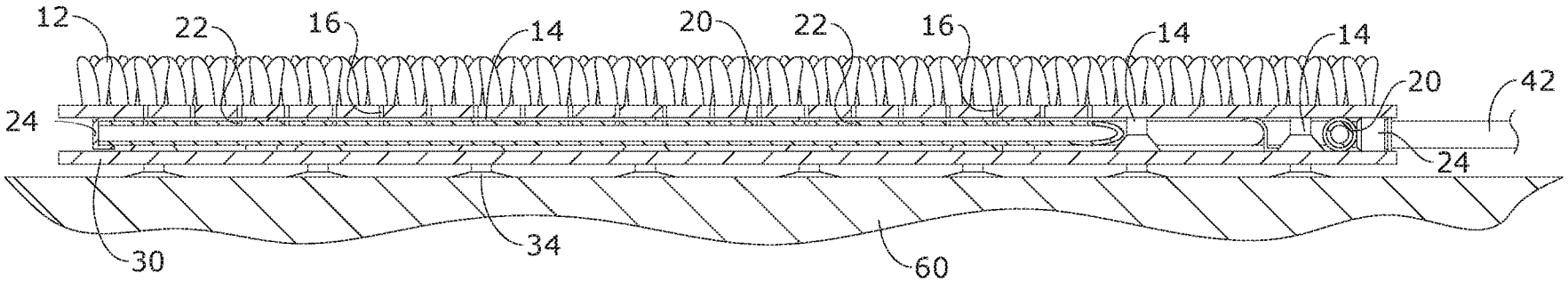
FIG. 5 is a section view of the shower mat with auxiliary shower spray hose, taken along line 5-5 in FIG. 4.
Figure 6:
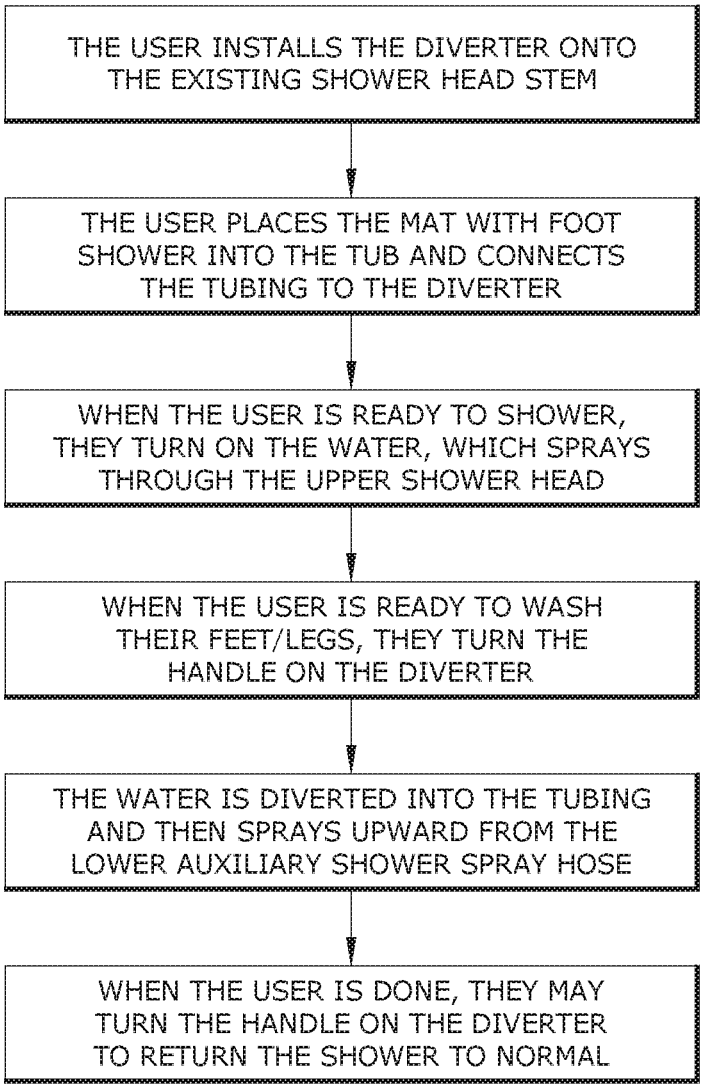
FIG. 6 is a flow chart of typical use of the shower mat with auxiliary shower spray hose.

As seen in reference to FIGS. 3 and 5, the shower mat may include an upper shower mat 10 and a lower shower mat 30. The upper shower mat 10 may include a plurality of resilient bristles 12 disposed in a spaced apart relation about a top surface of the upper shower mat 10. A plurality of jet apertures 16 are defined through the upper shower mat 10 and are oriented to align with a plurality of spray holes 21 in the auxiliary shower spray conduit 20. The plurality of jet apertures 16 and the plurality of spray nozzles are interposed between the plurality of resilient bristles 12. An end plug 22 at a terminal end of the auxiliary shower spray conduit 20 provides back pressure to direct the water flow through the plurality of spray holes 21 in the auxiliary shower spray conduit 20.

A bottom surface of the upper shower mat 10 has a plurality of spacer elements 14 to define a cavity subjacent to the upper shower mat 10. A bottom end of the spacer elements 14 may include a suction cup to join the upper shower mat to one of the lower shower mat 30 or a surface of the shower enclosure 60.

The lower shower mat has a smooth top surface to receive the spacer elements 14 and suction cups of the upper shower mat 10. One or more conduit clips 46 may be employed to secure the auxiliary shower spray conduit 20 to one or more of the upper shower mat 10, the lower shower mat 30, or a floor of the shower enclosure 60.

A connector 26 may be provided to interconnect the auxiliary shower spray conduit 20 with a tubing connector 43 defined at a terminal end of the tubing connector segment 42 and the tubing 40. The tubing connector segment 42 may then connect with the fitting 24 at an input of the auxiliary shower spray conduit 20.

To use the present invention, the user would install the diverter valve 50 to the stem 62. The mat's 10, 30 are installed within the shower enclosure 60 and the tubing 40 is interconnected between the diverter valve 50 and the auxiliary shower spray conduit 20 as described above. When the user is ready to shower, they turn on the water supply at the water control valves. With the diverter valve 50 in the first position, the water sprays from the primary shower head 64. When the user is ready to wash their feet and legs, they operate the diverter valve handle 56 of the diverter valve to the second position to divert water to emit through the plurality of spray holes 21 of the auxiliary shower spray conduit 20. The water is emitted vertically upward through the plurality of spray holes 21 and the aligned so that the user may cleanse their lower extremities. If desired, the user may select an intermediate position and enjoy a full body shower via the primary shower head 64 and the auxiliary shower spray conduit 20.

A bathtub or shower enclosure 60 may thus be readily equipped to provide a foot, leg and lower body cleaning with a constant stream of water emitted from a top surface of the upper shower mat 10. This assures the feet, legs and lower body are thoroughly clean after a shower if this mat is used properly. The bathtub or shower foot, leg and body cleaning mat can be used with a cleaning agent followed by a water rinse from the mat. The bathtub or shower foot, leg and body cleaning mat can be placed directly on the floor of a bathtub or shower so that a person may stand upright or in a chair for an elderly or disability person. The present invention thus provides a constant stream of water to the shower mat for the proper cleaning of people of all ages, disability at home and in facilities (hospitals, rehab centers, etc.). The present invention may also be utilized without the primary shower head 64 to provide a vertically oriented spray and mat. Optionally, the shower mat with auxiliary shower spray conduit 20 may be mounted to a wall of the shower enclosure 60 to provide a laterally directed auxiliary spray stream.

It should be understood, of course, that the foregoing relates to exemplary embodiments of the invention and that modifications may be made without departing from the spirit and scope of the invention as set forth in the following claims.

What is claimed is:

1. A shower mat with auxiliary shower spray conduit, comprising:

a first mat formed of a resilient material having a plurality of bristles disposed in a spaced apart relation about a top surface of the first mat;

an auxiliary shower spray conduit disposed in a serpentine orientation subjacent to the first mat, the auxiliary shower spray conduit configured to connect to a pressurized water source;

a plurality of spray holes disposed in a spaced apart relation along a length of the auxiliary shower spray conduit; and a plurality of jet apertures disposed through the first mat and aligned with the plurality of spray holes, and oriented to direct a flow from the pressurized water source vertically upwardly.

2. The shower mat of claim 1, further comprising:

a plurality of spacers extending from a bottom surface of the first mat, the plurality of spacers defining a cavity subjacent to the first mat and a mounting surface to contain the auxiliary shower spray conduit.

3. The shower mat of claim 2, further comprising:

a suction cup defined at a bottom end of the plurality of spacers.

4. The shower mat of claim 1, further comprising:

a second mat having a smooth top surface and a plurality of suction cups disposed about a bottom surface of the second mat.

5. The shower mat of claim 4, further comprising:

a plurality of clips to secure an auxiliary shower spray conduit to one or more of the first mat or the second mat.

6. The shower mat of claim 1, further comprising:

a diverter valve connectable between a stem of a shower enclosure and a primary shower head of the shower enclosure, wherein the diverter valve is operable between a first position directing a flow of pressurized water to the primary shower head and a second position directing the flow of pressurized water to the auxiliary shower spray conduit.

7. The shower mat of claim 6, wherein the diverter valve directs a proportion of the flow between the primary shower head and the auxiliary shower spray conduit when operated at an intermediate position between the first position and the second position.

8. The shower mat of claim 7, further comprising:

an elongate tube having a first end and a second end, wherein the first end is adapted to connect to the diverter valve and the second end is adapted to connect to an inlet of the auxiliary shower spray conduit.

9. The shower mat of claim 8, wherein the elongate tube further comprises:

a tubing connector segment interposed between the inlet and the second end of the elongate tube.

10. A shower mat with auxiliary shower spray conduit, comprising:

a first mat formed of a resilient material having a plurality of jet apertures disposed in a spaced apart relation through the first mat;

an auxiliary shower spray conduit disposed in a serpentine orientation subjacent to the first mat, the auxiliary shower spray conduit configured to connect to a pressurized water source; and a plurality of spray holes disposed in a spaced apart relation along a length of the auxiliary shower spray conduit, with the plurality of spray holes aligned with a corresponding one of the plurality of jet apertures.

11. The shower mat of claim 10, further comprising:

a plurality of bristles disposed in a spaced apart relation about a top surface of the first mat.

12. The shower mat of claim 11, further comprising:

a plurality of spacers extending from a bottom surface of the first mat, the plurality of spacers defining a cavity subjacent to the first mat to contain the auxiliary shower spray conduit.

13. The shower mat of claim 12, further comprising:

a suction cup defined at a bottom end of the plurality of spacers.

14. The shower mat of claim 13, further comprising:

a second mat having a smooth top surface; and a plurality of suction cups attached to a bottom surface of the second mat.

15. The shower mat of claim 14, further comprising:

a plurality of clips to secure the auxiliary shower spray conduit to one or more of the first mat or the second mat.

* * * * *